US008771167B2

(12) United States Patent
Grasso

(10) Patent No.: US 8,771,167 B2
(45) Date of Patent: Jul. 8, 2014

(54) MIDDLE EAR IMPLANT FOR OTOSCLEROSIS

(75) Inventor: Peter Grasso, Bolzano (IT)

(73) Assignee: Vibrant Med-E1 Hearing Technology GmbH, Innsbruck (AT)

( * ) Notice: Subject to any disclaimer, the term of this patent is extended or adjusted under 35 U.S.C. 154(b) by 123 days.

(21) Appl. No.: 13/405,471

(22) Filed: Feb. 27, 2012

(65) Prior Publication Data

US 2012/0220818 A1 Aug. 30, 2012

Related U.S. Application Data

(60) Provisional application No. 61/447,273, filed on Feb. 28, 2011.

(51) Int. Cl.
*H04R 25/00* (2006.01)

(52) U.S. Cl.
USPC ..... 600/25

(58) Field of Classification Search
USPC ..... 600/25; 607/55–57, 137; 381/23.1, 312
See application file for complete search history.

(56) References Cited

U.S. PATENT DOCUMENTS 5,624,376 A * 4/1997 Ball et al. ..... 600/25
6,491,722 B1 * 12/2002 Kroll et al. ..... 623/10

FOREIGN PATENT DOCUMENTS

WO WO 96/21335 7/1996 ..... H04R 25/00

OTHER PUBLICATIONS

Cowan et al., "Otosclerosis", Grand Rounds Presentation, UTMB, Dept. of Otolaryngology, Oct. 18, 2006.*
Service, Geoffrey J., et al, "Alternative Placement of the Floating Mass Transducer in Implanting the MED-EL Vibrant Soundbridge", *Operative Techniques in Otolaryngology-Head and Neck Surgery*, vol. 21, No. 3, Sep. 1, 2010, pp. 194-196.
Su, Wen-Yang, et al, Anatomical Measurements of the Cochlear Aqueduct, Round Window Membrane, Round Window Niche, and Facial Recess, *The Laryngoscope*, vol. 92, No. 5, May 32, 1982, pp. 483-486.
European Patent Office, Officer Marco Righetti, International Search Report and Written Opinion, PCT/US2012/026692, date of mailing Jul. 6, 2012, 13 pages.

* cited by examiner

*Primary Examiner* — John Lacyk
(74) *Attorney, Agent, or Firm* — Sunstein Kann Murhy & Timbers LLP

(57) ABSTRACT

A middle ear transducer arrangement is described for engaging a round window membrane of a patient cochlea. A mechanical transducer is surgically implantable into a fixed position in the round window niche of the patient cochlea adjacent to the round window membrane. A drive face on the outer surface of the transducer has a diameter less than half the diameter of the round window membrane. The fixed position of the transducer engages the drive face against a side section of the round window membrane without engaging the center point to generate an acoustic stimulation signal for perception as sound.

14 Claims, 4 Drawing Sheets

MIDDLE EAR IMPLANT FOR OTOSCLEROSIS

This application claims priority from U.S. Provisional Patent Application 61/447,273, filed Feb. 28, 2011, which is incorporated herein by reference.

TECHNICAL FIELD

The present invention relates to hearing implants and specifically a transducer for patients suffering from otosclerosis.

BACKGROUND ART

A normal ear transmits sounds as shown in FIG. 1 through the outer ear 101 to the tympanic membrane (eardrum) 102, which moves the ossicles of the middle ear 103 (malleus, incus, and stapes) that vibrate the oval window and round window membranes of the cochlea 104. The cochlea 104 is a long narrow organ wound spirally about its axis for approximately two and a half turns. It includes an upper channel known as the scala vestibuli and a lower channel known as the scala tympani, which are connected by the cochlear duct. The cochlea 104 forms an upright spiraling cone with a center called the modiolar where the spiral ganglion cells of the acoustic nerve 113 reside. In response to received sounds transmitted by the middle ear 103, the fluid-filled cochlea 104 functions as a transducer to generate electric pulses which are transmitted to the cochlear nerve 113, and ultimately to the brain.

Hearing is impaired when there are problems in the ability to transduce external sounds into meaningful action potentials along the neural substrate of the cochlea 104. To improve impaired hearing, various types of hearing prostheses have been developed. For example, when a hearing impairment is related to the operation of the middle ear 103, a conventional hearing aid or a middle ear implant (MEI) device may be used to provide acoustic-mechanical vibration to the auditory system.

FIG. 1 also shows some components in a typical MEI arrangement where an external audio processor 100 processes ambient sounds to produce an implant communications signal that is transmitted through the skin to an implanted receiver 102. Receiver 102 includes a receiver coil that transcutaneously receives signals the implant communications signal which is then demodulated into a transducer stimulation signals which is sent over leads 106 through a surgically created channel in the temporal bone to a floating mass transducer (FMT) 104 in the middle ear. The transducer stimulation signals cause drive coils within the FMT 104 to generate varying magnetic fields which in turn vibrate a magnetic mass suspending within the FMT 104. The vibration of the inertial mass of the magnet within the FMT 104 creates vibration of the housing of the FMT 104 relative to the magnet. And since the FMT 104 is connected to the incus, it then vibrates in response to the vibration of the FMT 104 which is perceived by the user as sound.

FIG. 2 shows a functional representation of a normal cochlea 200. The oval window membrane 201 is a flexible tissue across the opening to the fluid filled scala vestibuli 203. Vibration from the footplate of the stapes drives the oval window membrane 201 creating pressure wave vibration in the fluid of scala vestibuli 203. This in turn creates sympathetic pressure wave vibration in the fluid filled scala tympani 204 on the other side of the basilar membrane 205. The pressure wave vibration of the fluid in the scala tympani 204 in turn drives the membrane of the round window membrane 202 with a phase shift of 180 degrees from the vibration of the oval window membrane 201.

Patients suffering from otosclerosis have serious ossification of their vibrating structures in the middle ear (e.g. ossicles) and in most cases also the membrane of the oval window membrane 201. Consequently, these patients have a severe conductive hearing loss. One problem in connection with an ossified oval window membrane 201 is that the stapes foot plate cannot forward incoming acoustic sound in form of pressure waves into the fluid inside the cochlea 200. In the case of an entirely ossified oval window membrane 201, these patients can be completely deaf even if neural tissue in the cochlea 200 as whole is healthy.

To overcome this problem one could consider mechanically or acoustically stimulating the round window membrane 202 instead of the oval window membrane 201. FIG. 3 shows an example of one approach to round window membrane stimulation where a mechanical middle ear stimulator, e.g., a floating mass transducer (FMT) 301 is placed with its flat front side directly in contact with the tissue of the round window membrane 202 so that movement is not possible between them. This can be achieved by tightly pressing the FMT 301 towards the round window membrane 202 and fixing it there with material produced naturally in the body. Electrical drive signals are delivered from the connecting cable 302 to the FMT 301 which in turns drives the round window membrane 202. Preferably the FMT 301 is placed in the center of the round window membrane 202 where the tissue has its greatest possible elongation.

This method has been used for many patients and is an efficient method to treat hearing disorders for patients lacking of portions of middle ear ossicles. However, because the cochlear fluid is incompressible, a movement of the round window membrane 202 requires a corresponding movement of the oval window membrane 201. But that is not possible when the oval window membrane 201 is immobilized due to ossification. So unfortunately, the arrangement shown in FIG. 3 is not suitable in patients suffering from otosclerosis. Nor can so called third window membranes in the cochlea 200 properly compensate the movement of an ossified round window membrane 202 or oval window membrane 201.

One existing treatment for patients suffering from severe ossification of the middle ear structures such as an ossified oval window membrane uses a so called stapetectomy where a small hole is drilled into the stapes foot plate. A mechanical actuator then is inserted through this hole into direct contact with the cochlear fluid to deliver pressure waves into the cochlea. However, opening and maintaining a permanent hole in the stapes footplate is dangerous due to increased infection risk. Other disadvantages are described in Lupo et. al., *Prospective Electrophysiologic Findings of Round Window membrane Stimulation in a Model of Experimentally Induced Stapes Fixation*, Otology & Neurology 2009, pp 1-10; which is incorporated herein by reference.

The same paper by Lupo et al. presents a novel method for treating patients suffering from otosclerosis. A ball shaped electrode with a diameter of 1 mm is used on top of a transducer which mechanically stimulates the round window membrane when at the same time the oval window membrane is fixed. The authors further report on the measurement of the amplitude of the Cochlear Microphonic (CM) signal, of the Compound Action Potential (CAP) signal and of the Auditory Brainstem Response (ABR).

SUMMARY

Embodiments of the present invention are directed to a middle ear transducer arrangement for engaging a round window membrane of a patient cochlea. A mechanical transducer is surgically implantable into a fixed position in the round window niche of the patient cochlea adjacent to the round window membrane. A drive face on the outer surface of the transducer has a diameter less than half the diameter of the round window membrane. The fixed position of the transducer engages the drive face against a side section of the round window membrane without engaging the center point to generate an acoustic stimulation signal for perception as sound.

In further specific embodiments, the drive face may be a flat or a spherical section surface which may be engaged to the side section of the round window membrane by a fluid film. The mechanical transducer may be a floating mass transducer (FMT). The patient cochlea may include an ossified oval window membrane.

Embodiments of the present invention also include a middle ear transducer arrangement for engaging a round window membrane of a patient cochlea where a pair of adjacent mechanical transducers are surgically implantable into a fixed position in the round window niche of the patient cochlea adjacent to the round window membrane and arranged to operate in opposite phase to each other. A drive face is on an outer surface of each transducer having a diameter less than half the diameter of the round window membrane. The fixed position of the transducers engages each drive face against a different side section of the round window membrane without engaging the center point to generate an acoustic stimulation signal for perception as sound.

In further specific embodiments, the drive face may be a flat surface or a spherical section surface which may be engaged to the side section of the round window membrane by a fluid film. The mechanical transducer may be a floating mass transducer (FMT). The patient cochlea may include an ossified oval window membrane.

Embodiments of the present invention also include a hearing implant system having a middle ear transducer arrangement according to any of the foregoing.

DETAILED DESCRIPTION

Figure 1:
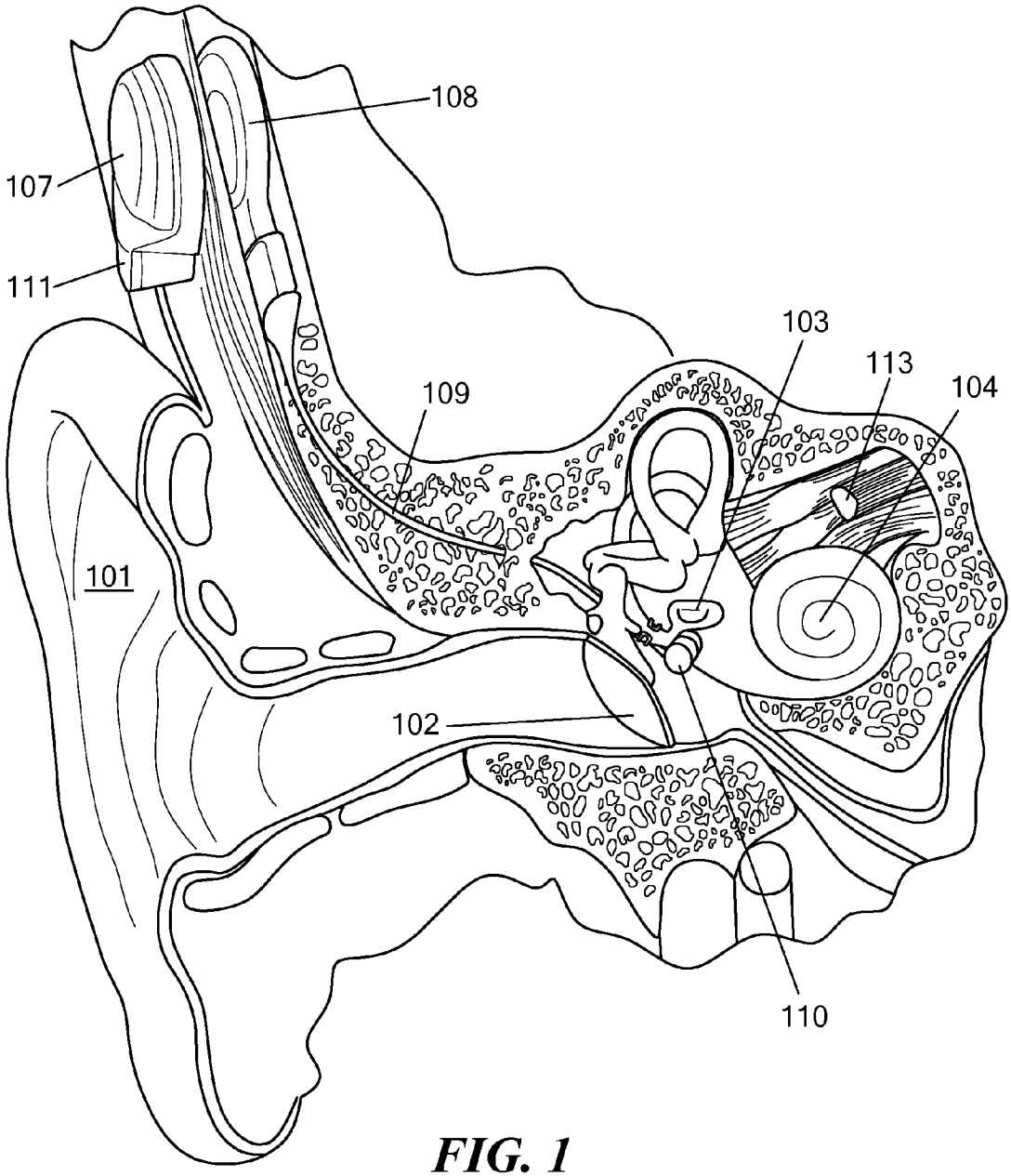
FIG. 1 shows the anatomy of a human ear and various structures in a middle ear hearing implant system.
Figure 2:
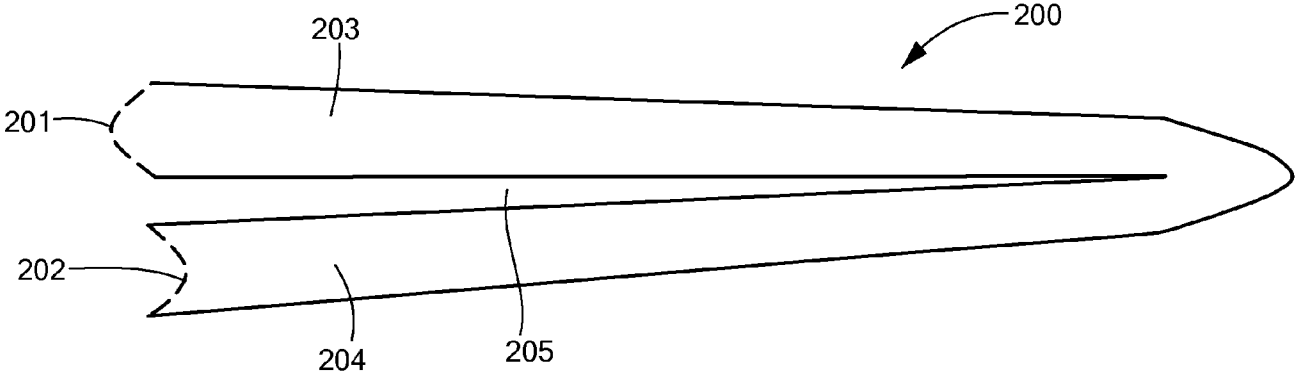
FIG. 2 shows a functional representation of a normal cochlea.
Figure 3:
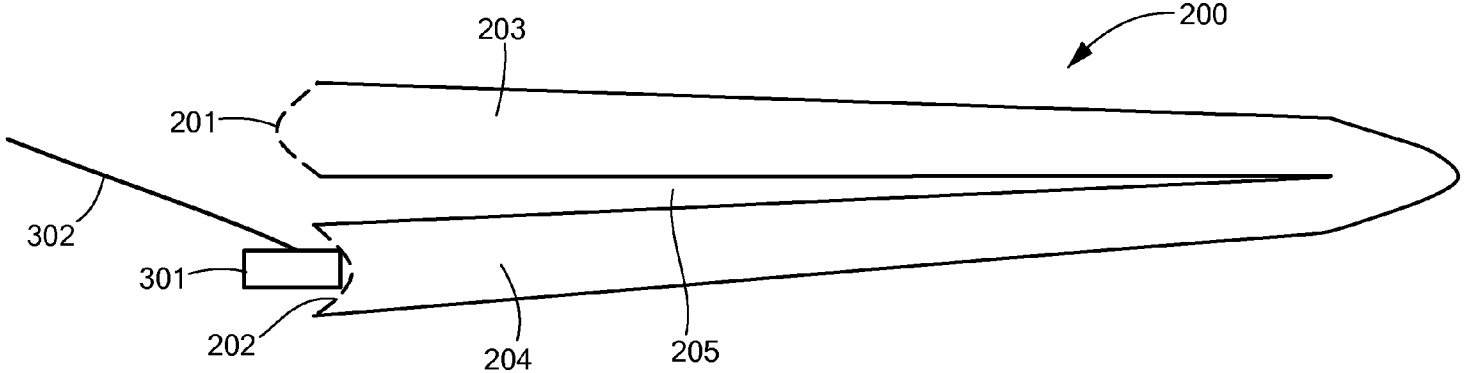
FIG. 3 shows a functional representation of a normal cochlea having a mechanical transducer engaged against the round window membrane.

Various embodiments of the present invention are directed to a middle ear implant (MEI) which provides significant hearing improvement to patients suffering from otosclerosis with an ossified oval window membrane. FIGS. 4 A-B shows a functional representation of a human cochlea 200 with an ossified oval window membrane 401 having an offset mechanical transducer 404 engaged against the round window membrane 402 according to an embodiment of the present invention. The mechanical transducer 404 such as a floating mass transducer (FMT) is surgically implantable at an angle into a fixed position in the round window niche 403 of the patient cochlea 200 adjacent to the round window membrane 402.

A drive face 406 on the outer surface of the transducer 404 has a diameter less than half the diameter of the round window membrane 402. The drive face 406 may be, for example, a flat surface or a spherical section surface (e.g., a ball shaped tip as in Lupo). The fixed position of the transducer 404 engages the drive face 406 against a side section of the round window membrane 402 without engaging the center point to generate an acoustic stimulation signal for perception as sound. This leaves a considerable portion of the round window membrane 402 (more than 50%) open without contact by the drive face 406, which can compensate for the volume changes in the cochlea 200 caused by the transducer 404. That is, when the drive face 406 of the transducer 404 pushes in against the round window membrane 402 creating a pressure wave vibration in the fluid of the scala tympani 204, then the displaced volume of cochlear fluid also moves the open portion of the round window membrane 404 outward as shown in FIG. 4A.

Figure 4A:
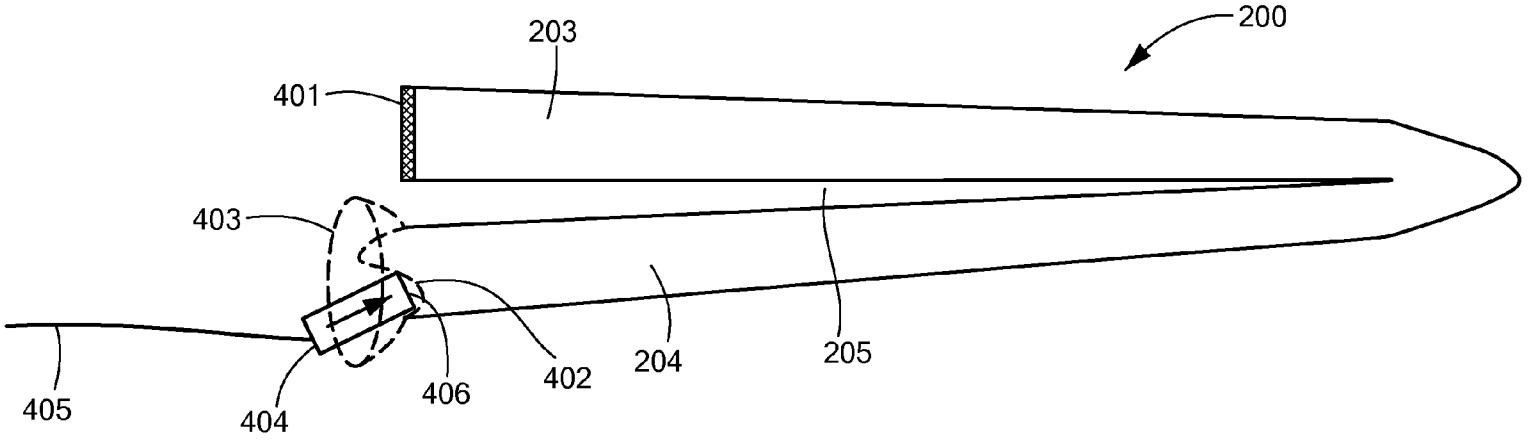
FIGS. 4 A-B shows a functional representation of a normal cochlea having an offset mechanical transducer engaged against the round window membrane according to an embodiment of the present invention.
Figure 4B:
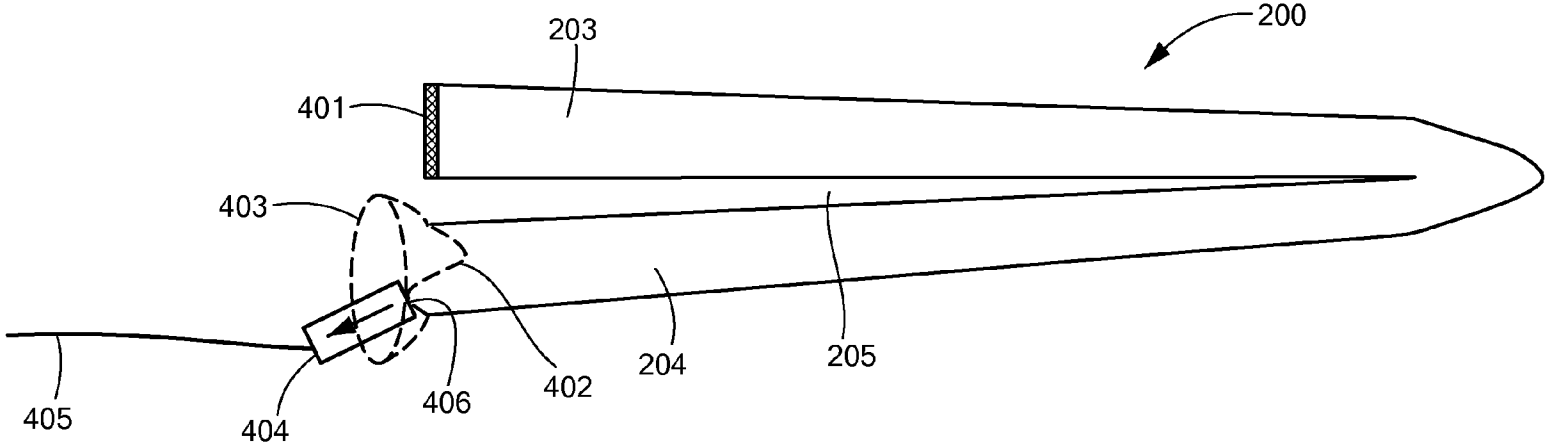

Moreover, cochlear stimulation occurs not only by inward directed pressure to the round window membrane 402 as shown in FIG. 4A, but also by return outward directed traction of the round window membrane 402 on the drive face 406 when the transducer 404 moves back outward as shown in FIG. 4B. If the drive face 406 just gently contacts the round window membrane 402, then there will also be a thin film of body fluids (mainly water) between the drive face 406 and round window membrane 402. This film creates a suction force that pulls the round window membrane 402 back outward with the front face 406 (especially when the front face 406 is flat plane shape) as the transducer moves in the outward direction as shown in FIG. 4B. This again allows the open portion of the round window membrane to compensate for the volume change of the fluid in the scala tympani 204 by flexing back inward as shown in FIG. 4B.

Figure 5:
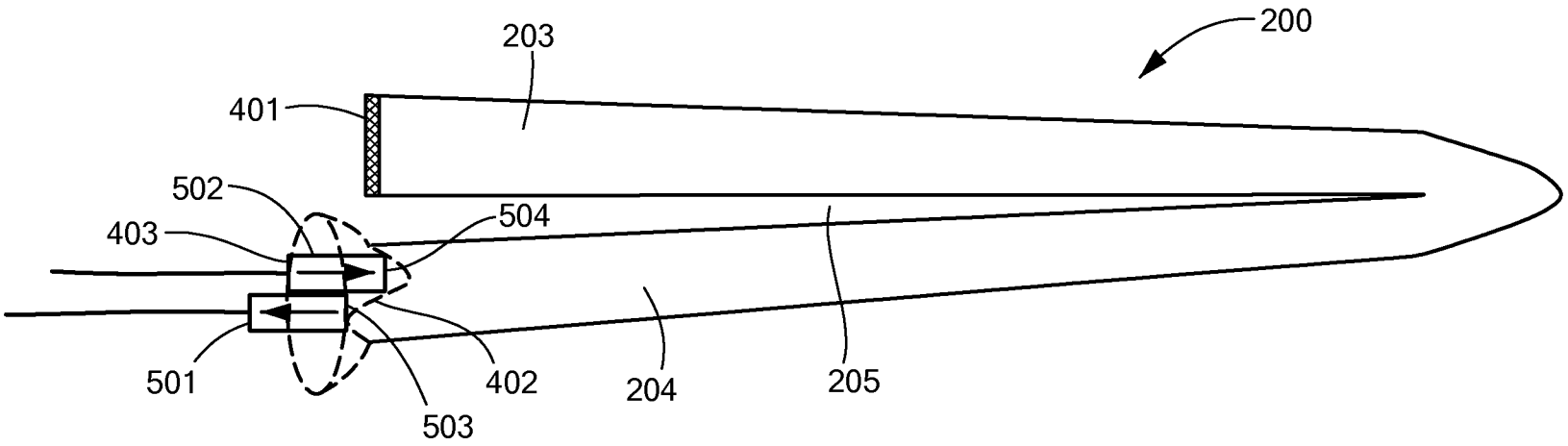
FIG. 5 shows a functional representation of a normal cochlea having an arrangement of a pair of offset mechanical transducers engaged against the round window membrane according to an embodiment of the present invention.

FIG. 5 shows a functional representation of a cochlea 200 having a pair of offset mechanical transducers 501 and 502 engaged against the round window membrane 402 according to another embodiment of the present invention. In this arrangement, the pair of adjacent mechanical transducers 501 and 502 are surgically implantable into a fixed position in the round window niche 403 of the cochlea 200 adjacent to the round window membrane 402 and arranged to operate in opposite phase to each other. A drive face 503 and 504 is on an outer surface of each transducer 501 and 502 each having a diameter less than half the diameter of the round window membrane 402. The fixed position of the transducers 501 and 502 engages each drive face 503 and 504 against a different side section of the round window membrane 402 without engaging the center point to generate an acoustic stimulation signal for perception as sound. Again, the different sections of the round window membrane 402 flex in and out responsive to the 180 degree opposing movements of the drive faces 503 and 504 similar to the operation as in FIGS. 4 A-B.

Although various exemplary embodiments of the invention have been disclosed, it should be apparent to those skilled in the art that various changes and modifications can be made which will achieve some of the advantages of the invention without departing from the true scope of the invention.

What is claimed is:

1. A middle ear transducer arrangement for engaging a round window membrane of a patient cochlea, the round window membrane having a center point and a diameter, the transducer arrangement comprising:

a mechanical transducer configured to be surgically implantable into a fixed position in the round window niche of the patient cochlea adjacent to the round window membrane, the mechanical transducer configured to generate a pressure wave vibration in the fluid of the scala tympani and to allow a displaced volume of cochlear fluid to move an open portion of the round window membrane outwards from the scala tympani, and further comprising a drive face on an outer surface of the transducer having a diameter less than half the diameter of the round window membrane, the drive face configured to engage, when the mechanical transducer is surgically implanted into the fixed position in the round window niche, against a side section of the round window membrane offset from the center point to generate an acoustic stimulation signal for perception as sound, and leaving an opposing portion of the round window membrane open and unengaged for an offset displacement for a volume change in the cochlea caused by the mechanical transducer due to the acoustic stimulation signal.

2. A middle ear transducer arrangement according to claim 1, wherein the drive face is configured to be engaged to the side section of the round window membrane by a fluid film.

3. A middle ear transducer arrangement according to claim 1, wherein the drive face is a flat surface.

4. A middle ear transducer arrangement according to claim 1, wherein the drive face is a spherical section surface.

5. A middle ear transducer arrangement according to claim 1, wherein the mechanical transducer is a floating mass transducer (FMT).

6. A middle ear transducer arrangement according to claim 1, wherein the patient cochlea includes an ossified oval window membrane.

7. A hearing implant system having a middle ear transducer arrangement according to any one of the claims 1-6.

8. A middle ear transducer arrangement for engaging a round window membrane of a patient cochlea, the round window membrane having a center point and a diameter, the transducer arrangement comprising:

a first mechanical transducer configured to be surgically implantable into a first fixed position in the round window niche of the patient cochlea adjacent to the round window membrane, and comprising a first drive face on an outer surface of said first transducer, the first drive face having a diameter less than half the diameter of the round window membrane; and a second mechanical transducer configured to operate in opposite phase to the first mechanical transducer, and configured to be surgically implantable into a second fixed position in the round window niche of the patient cochlea adjacent to the first mechanical transducer and adjacent to the round window membrane, and comprising a second drive face on an outer surface of said second transducer, the second drive face having a diameter less than half the diameter of the round window membrane;

wherein each of the first and second drive faces is configured to engage, when the first and second mechanical transducers are surgically implanted into the fixed position in the round window niche, a different side section of the round window membrane without engaging the center point to generate an acoustic stimulation signal for perception as sound.

9. A middle ear transducer arrangement according to claim 8, wherein the drive face is configured to be engaged to the side section of the round window membrane by a fluid film.

10. A middle ear transducer arrangement according to claim 8, wherein the drive face is a flat surface.

11. A middle ear transducer arrangement according to claim 8, wherein the drive face is a spherical section surface.

12. A middle ear transducer arrangement according to claim 8, wherein the mechanical transducer is a floating mass transducer (FMT).

13. A middle ear transducer arrangement according to claim 8, wherein the patient cochlea includes an ossified oval window membrane.

14. A hearing implant system having a middle ear transducer arrangement according to any one of the claims 8-13.

* * * * *